United States Patent [19]

Damsky

[11] 4,040,710

[45] Aug. 9, 1977

[54] PLUG-IN ELECTRICAL RECEPTACLE EXTENDER

[76] Inventor: Arnold Marvin Damsky, 821 - 83rd St., Miami Beach, Fla. 33141

[21] Appl. No.: 688,982

[22] Filed: May 24, 1976

[51] Int. Cl.[2] ..... H01R 13/46

[52] U.S. Cl. ..... 339/154 A; 339/156 R; 339/166 R

[58] Field of Search ..... 339/153, 154 R, 154 A, 339/156 R, 157 R, 166 R

[56] References Cited

U.S. PATENT DOCUMENTS

| | | | |
|---|---|---|---|
| 2,702,893 | 2/1955 | Paulson | 339/166 R |
| 3,609,647 | 9/1971 | Castellano | 339/156 R |
| 3,963,301 | 6/1976 | Stark | 339/186 M |

*Primary Examiner*—Roy Lake

*Assistant Examiner*—Mark S. Bicks

*Attorney, Agent, or Firm*—Ernest H. Schmidt

[57] ABSTRACT

An electrical receptacle cover plate is integrally molded with plug receptacles having prong connector terminals extending rearwardly of a shallow housing portion for plug-in connection, through an opening in panelling or the like used in renovating interior walls, with already-installed electrical receptacles. The plug-in electrical receptacle interconnecting prongs are scored at spaced intervals along their lengths to permit ready adjustment to the length required for inter-receptacle connection, depending upon the distance between the inner wall covered and the outer surface of the new wall. Electrically insulating spacer wafers threaded on the interconnection prong, serve to insulate portions thereof intermediate the existing receptacle and the plug-in receptacle extender.

4 Claims, 4 Drawing Figures

PLUG-IN ELECTRICAL RECEPTACLE EXTENDER

In the remodeling of rooms by the installation of paneling, for example, or other materials of substantial thickness, particularly when furring strips are used between the wall surface and the paneling or other sheet material being used for remodeling, difficulties are often encountered in relocating existing electrical outlets in the added paneling. Heretofore, it has been common practice to remove the receptacle from its electrical connector box and attach it by means of wood screws or the like against marginal portions of an opening cut in a panel for this purpose, to be covered thereafter by a cover plate in the usual manner. If the original wiring in the connector box happened to be too short to permit the required extension of the receptacle, splicing became necessary, making the relocation even more difficult. More often than not such relocation of a receptacle is done by the carpenter installing the paneling instead of by a licensed electrician, resulting not infrequently in a faulty and hazardous condition. This is especially true when grounding of the receptacle to the metallic receptacle box is lost upon its removal and reassembly to the non-electrically conductive paneling.

It is, accordingly, the principal object of this invention to provide a novel and improved plug-in electrical receptacle extender for use in renovating wall paneling and the like that obviates the above-described difficulties and hazards in the relocation of properly installed existing receptacles.

A more particular object of the invention is to provide a plug-in electrical receptacle extender of the character described which will permit simple plug-in interconnection with the pre-existing electrical receptacle through a relatively small opening in the paneling being installed, and which, at the outside upon installation, has the appearance of an ordinary plug-in electrical receptacle with cover plate.

Another object of the invention is to provide a plug-in electrical receptacle extender of the above nature including a cover plate integrally formed with a rearwardly-extending portion defining ordinary electric plug receptacle openings at the front and containing plug contact elements extending rearwardly of the housing portion in the form of electrical receptacle prongs adapted to plug into an existing receptacle to provide for electrical interconnection between the existing receptacle and the receptacle extension device.

Another object of the invention is to provide a plug-in electrical receptacle extender of the above nature wherein the electrical connection extension prongs are scored at spaced intervals along their lengths to enable easy cut-off or break-off to an appropriate length for full interfitting connection with an existing electrical receptacle, depending upon the spacing between the covered wall and the outer paneling.

Yet another object of the invention is to provide a plug-in electrical receptacle extender of the character described including insulating wafers or spacers fitted along the interconnecting prongs in sufficient quantity to fully insulate them between the body portion of the receptacle extender and the original electrical receptacle plugged into.

Yet another object of the invention is to provide a plug-in electric receptacle extender of the character described which will be simple in construction, economical to manufacture, simple to install, and safe in operation.

Other objects, features and advantages of the invention will be apparent from the following description when read with reference to the accompanying drawings. In the drawings, wherein like reference numerals denote corresponding parts throughout the several views.

Figure 1:
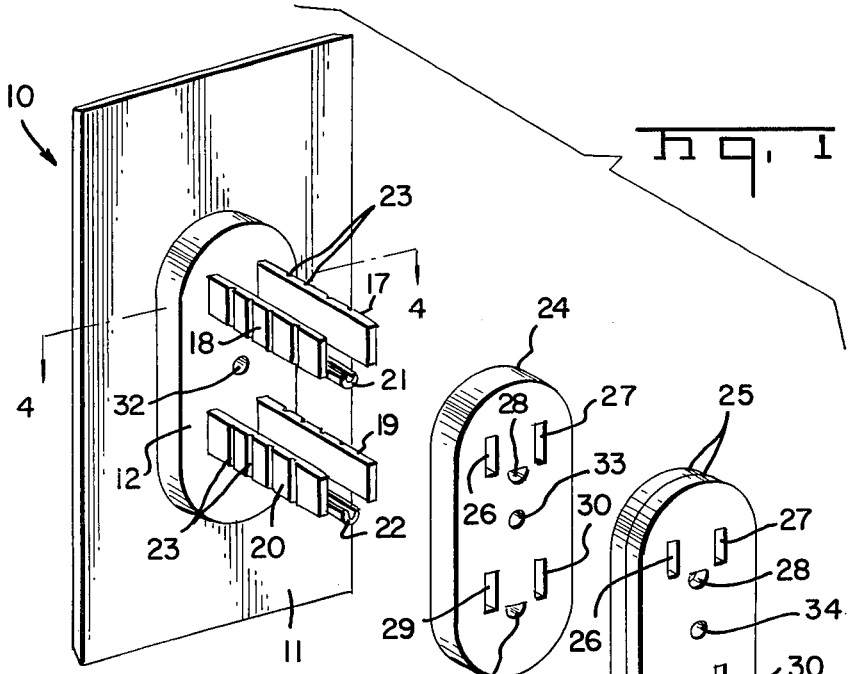
FIG. 1 is an exploded view in perspective as seen from the rear, of a plug-in electrical receptacle extender embodying the invention.
Figure 3:
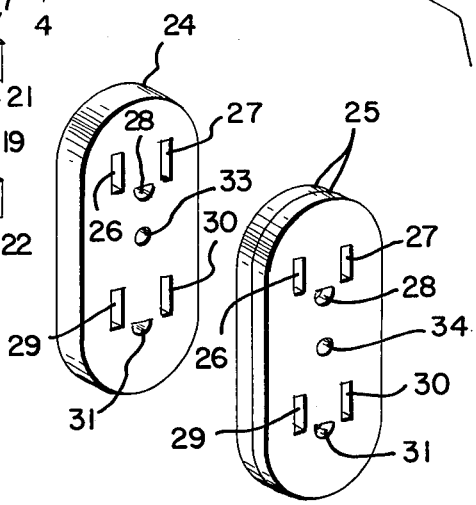
Figure 3:
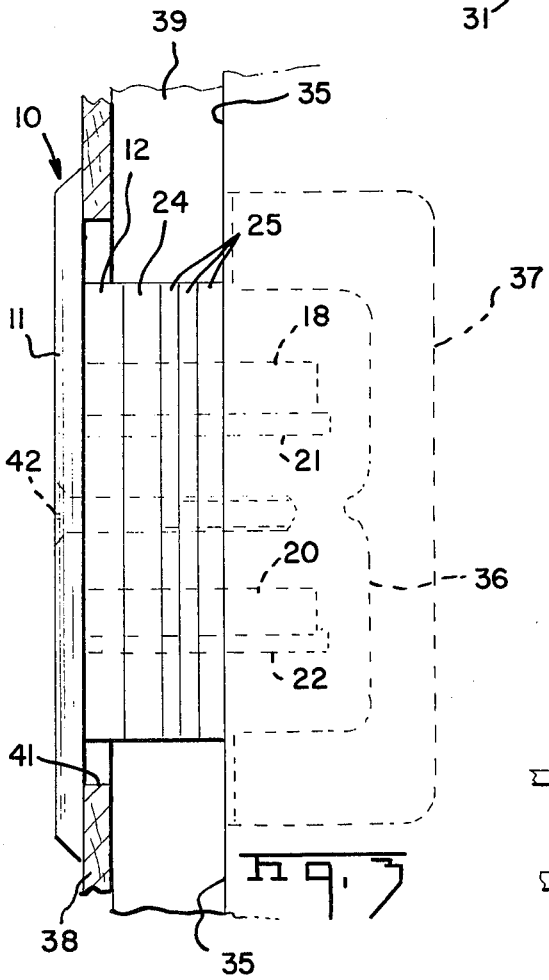
Figure 2:
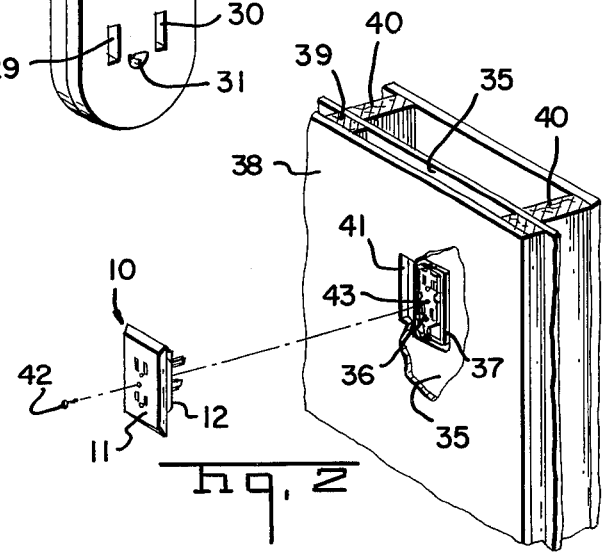
FIG. 2 is a partial perspective view, as seen from the outside of a wall section remodeled with paneling, illustrating how the plug-in electrical receptacle extender is installed in an opening in a panel and secured in place with respect to the original receptacle.
Figure 4:
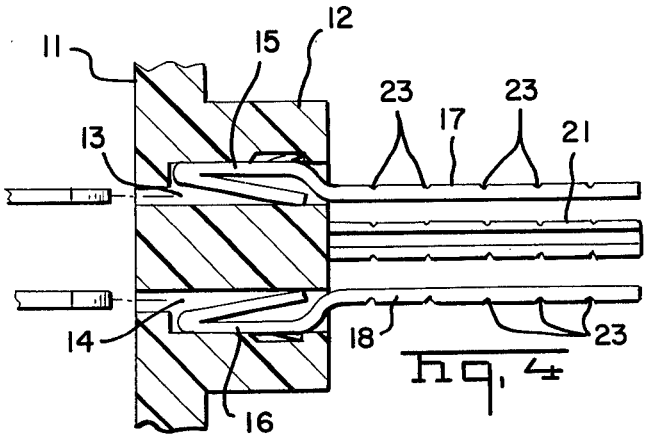

FIG. 3 is a longitudinal cross-sectional view taken through a paneled wall section as in FIG. 2 and illustrating the use of the prong insulating spacers between the electrical receptacle extender and the original electrical receptacle; and FIG. 4 is a horizontal cross-sectional view taken along the line 4—4 of FIG. 1 in the direction of the arrows and illustrating details of the receptacle extender connector prongs.

Referring now in detail to the drawings, reference numeral 10 designates, generally, a preferred form of plug-in electrical receptacle extender embodying the invention, the same comprising cover plate portion 11 integrally molded at the rear with a central outwardly-projecting, body portion 12 of reduced peripheral size. The body portion 12 if formed with prong openings 13, 14 (see FIG. 4) within which are received double-bent spring contactor portions 15, 16 of rearwardly outwardly-extending connector prongs 17, 18. The electrical receptacle extender illustrated by way of example is of the usual duplex type, and comprises a second pair of connector prongs 19, 20, as is best illustrated in FIG. 1. Also fitted within and extending outwardly of the body portion 12 of the electrical receptacle extender 10 are the usual ground prongs 21, 22, one for each pair of flat contact prongs 17, 18, 19, 20, arranged therebetween in conventional fashion. The connector prongs 17, 18, 19, 20, 21 and 22 are all scored at spaced intervals along their lengths, as indicated at 23 in FIGS. 1 and 4, to provide transverse zones of weakness facilitating breaking off to the desired length in accordance with the particular installation to be made, as is hereinafter more particularly described.

The receptacle extender 10 also comprises a plurality of spacers 24 and 25, integrally molded of a non-electrically conductive material such as Bakelite, said spacers being of different thickness and having a peripheral shape substantially the same as that of the body portion 12. The spacers 24, 25 are provided with sets of through openings 26, 27, 28, and 29, 30 and 31 for through passage of the contactor prong sets 17, 18, 21, and 19, 20, 22, respectively, in the manner and for the purpose hereinbelow more particularly described. The cover plate 11 and its integrally formed body portion 12 are provided with a central through opening 32, and the spacers 24, 25 are similarly provided with central through openings 33, 34 for passage of an attachment screw upon installation of the receptacle extender, as is hereinafter described.

Referring now to FIGS. 2 and 3 and considering a typical installation of a plug-in electrical receptacle extender embodying the invention, reference numeral 35 designates the outer surface of a wall to be renovated by paneling, said wall having an existing duplex electrical receptacle 36 installed in the usual metal electrical box 37. In accordance with the teachings of my invention, it is only necessary to remove the usual cover plate (not illustrated) before the installation of paneling. As illustrated in FIGS. 2 and 3, the paneling 38 will be nailed or otherwise secured to furring strips 39 nailed through the existing wall surface into wall studs 40. To install the plug-in electrical receptacle extender 10 it is only necessary to provide an opening 41 in the paneling, in alignment with the pre-existing electrical receptacle 36, the opening to be of sufficient size to permit passage of the body portion 12. Upon completion of the paneling it is only necessary to plug in the electrical receptacle extender 10 through the panel hole 41 and measure the approximate distance between the outer surface of the paneling and the inner surface of the cover plate portion 11, which distance represents the excess length of the connector prongs 17, 18, 21, and 19, 20, 22 to be removed for flush fit. The connector prongs will preferably be scored along their lengths at approximately quarter inch intervals, to provide for substantially full plug-in to the existing electrical receptacle 36 while at the same time providing for flush installation. To complete the installation, a sufficient number of spacers 24, 25 will be threaded on the prongs of the plug-in electrical receptacle extender 10 to fill the gap between it and the pre-existing duplex receptacle 36, whereafter a machine screw 42 will be applied through the central openings 32, 33 and 34 for attachment to the threaded opening 43 (cover plate attachment opening) in the existing electrical receptacle 36.

While the outer face of the cover plate portion 11 of the receptacle extender 10 is illustrated as being of plain, flat appearance, it will be understood that my invention also contemplates the provision of ornamental or decorative cover plate portions, not necessarily of strictly rectangular shape, as may be desired for room beautification. Thus, while I have illustrated and described herein only one form in which my invention can conveniently be embodied in practice, it is to be understood that this form is presented by way of example only and not in a limiting sense. My invention, in brief, comprises all the embodiments and modifications coming within the scope and spirit of the following claims.

What I claim as new and desire to secure by Letters Patent is:

1. A plug-in electrical receptacle extender comprising, in combination, a flat electrical receptacle cover plate, a comparatively thick body member extending centrally outwardly of one side of said plate and integrally formed therewith, a plurality of electrical prong connector terminals secured in said body member and extending perpendicularly outwardly thereof at said one side of said cover plate, end portions of said prong connector terminal extensions being adapted to fit into corresponding prong connector terminal openings in an electrical receptacle to be extended for making electrical connection therewith, and a non-electrically conductive apertured spacer slidingly received over said prongs for electrically insulating said electrical plug terminal extensions between said body member and end portions of said extensions to be fitted into an electrical receptacle.

2. A plug-in electrical receptacle extender as defined in claim 1, wherein said prong connector terminal extensions are all scored at spaced intervals along their lengths to provide transverse zones of weakness facilitating breaking off at the selected length for insertion into the electrical receptacle.

3. A plug-in electrical receptacle extender as defined in claim 1 including a plurality of said non-electrically conductive apertured spacers.

4. A plug-in electrical extender as defined in claim 3 wherein said prong connector terminal extensions are all scored at spaced intervals along their lengths to provide transverse zones of weakness facilitating breaking off at the selected length for insertion into the electrical receptacle.

* * * * *